US010273074B2

(12) United States Patent
Lutzig

(10) Patent No.: US 10,273,074 B2
(45) **Date of Patent: *Apr. 30, 2019**

(54) RECLOSABLE CONTAINER

(71) Applicant: PHILIP MORRIS USA INC., Richmond, VA (US)

(72) Inventor: Bodo-Werner Lutzig, Chavornay (CH)

(73) Assignee: Philip Morris USA Inc., Richmond, VA (US)

( * ) Notice: Subject to any disclaimer, the term of this patent is extended or adjusted under 35 U.S.C. 154(b) by 301 days.

This patent is subject to a terminal disclaimer.

(21) Appl. No.: 15/170,312

(22) Filed: Jun. 1, 2016

(65) Prior Publication Data

US 2016/0272409 A1 Sep. 22, 2016

Related U.S. Application Data

(63) Continuation of application No. 12/645,504, filed on Dec. 23, 2009, now Pat. No. 9,359,124.

(30) Foreign Application Priority Data

Dec. 23, 2008 (EP) ..... 08172706

(51) Int. Cl.

| | |
|---|---|
| ***B65D 5/56*** | (2006.01) |
| ***B65D 85/10*** | (2006.01) |
| ***B65D 5/66*** | (2006.01) |
| ***B65D 75/58*** | (2006.01) |

(52) U.S. Cl.

CPC ..... *B65D 85/1045* (2013.01); *B65D 5/563* (2013.01); *B65D 5/662* (2013.01); *B65D 75/5838* (2013.01); *B65D 85/1027* (2013.01); *B65D 2575/586* (2013.01)

(58) Field of Classification Search

USPC ..... 220/495.01, 23.87, 62.11, 62.22, 495.05; 206/264, 242, 274; 229/160.1

See application file for complete search history.

(56) References Cited

U.S. PATENT DOCUMENTS

| | | | |
|---|---|---|---|
| 1,117,016 | A | 11/1914 | Falk |
| 2,204,850 | A | 6/1940 | Escobales |
| 3,171,583 | A | 3/1965 | Klein |
| 3,273,784 | A | 9/1966 | Porter |
| 3,275,469 | A | 9/1966 | Streit |
| 3,402,877 | A | 9/1968 | Pinkham |
| 4,375,260 | A | 3/1983 | Focke et al. |
| 4,771,882 | A | 9/1988 | Lowe et al. |
| 4,818,609 | A | 4/1989 | Schmoock |
| 4,852,734 | A | 8/1989 | Allen et al. |
| 5,292,058 | A | 3/1994 | Zoss et al. |
| 5,333,729 | A | 8/1994 | Wolfe |
| 5,341,925 | A | 8/1994 | Fleenor et al. |
| 5,427,235 | A | 6/1995 | Powell et al. |

(Continued)

*Primary Examiner* — Jeffrey R Allen

(74) *Attorney, Agent, or Firm* — Buchanan Ingersoll & Rooney LLP

(57) ABSTRACT

A reclosable container for consumer items includes a box, a lid hingedly connected to the box, an inner liner wrapped around the consumer items, the inner liner including a section defining an opening for allowing access to the consumer items, means to open and reclose the opening, and an inner frame attached to the box. The inner frame includes a free inner frame portion protruding from the box towards the opening in the inner liner. The free inner frame portion includes a cut out and the inner frame is attached to the inner liner proximate to the cut out.

20 Claims, 3 Drawing Sheets

(56) References Cited

U.S. PATENT DOCUMENTS

| | | | |
|---|---|---|---|
| 5,819,924 | A | 10/1998 | Sigrist et al. |
| 5,938,018 | A | 8/1999 | Keaveney et al. |
| 6,164,444 | A | 12/2000 | Bray et al. |
| 6,364,113 | B1 | 4/2002 | Faasse et al. |
| 6,874,623 | B2 | 4/2005 | Bray |
| 6,878,224 | B1 | 4/2005 | Focke et al. |
| 7,344,024 | B2 | 3/2008 | Focke et al. |
| 2008/0308432 | A1 | 12/2008 | Lutzig et al. |

RECLOSABLE CONTAINER

CROSS-REFERENCE TO RELATED APPLICATION

This application is a Continuation Patent Application of U.S. patent application Ser. No. 12/645,504, filed Dec. 23, 2009 and claims priority to European Application No. 08172706.7, filed Dec. 23, 2008, the entire contents of which are incorporated herein by this reference thereto.

BACKGROUND

It is known to package consumer items in containers formed from folded laminar blanks. In order to preserve freshness of the consumer items known containers may have reclosable features that allow the consumer to reclose the container between the removal of consumer items.

For example, such a container is disclosed in the EP-A-0 944 539. The container includes a bundle of smoking articles which is sealed into an inner liner. The inner liner includes a reclosable aperture in the top section and an inner frame within the inner liner. The aperture in the inner liner requires a sophisticated inner liner blank and an additional inner frame.

EP-A-1 037 822 discloses a container where the sealed bundle is housed within a cardboard container with a hinged lid.

There is a need for a container for consumer items that provides improved freshness preservation and which is simple in structure and cost effective in production.

The present invention relates to a reclosable container for consumer items. The container according to the invention is particularly suitable for elongate smoking articles, for example cigarettes, cigarillos and cigars.

SUMMARY OF SELECTED ASPECTS OF THE INVENTION

A reclosable container for consumer items includes a box, a lid hingedly connected to the box, an inner liner wrapped about the consumer items, and an inner frame attached to the box. In the preferred embodiment, the inner liner includes a section defining an opening for allowing access to the consumer items, and means to open and reclose the opening. Also preferably, the inner frame includes a free inner frame portion protruding from the box towards the opening in the inner liner and the free inner frame portion includes a cut out. Moreover, the inner frame is attached to the inner liner proximate to the cut out.

In the preferred embodiment, the inner liner is made from a material with a bending stiffness ranging from about 4.5 N/m to about 12 N/m. Also preferably, the inner liner includes a layer of paper having a weight ranging from about 80 grams per square meter to about 150 grams per square meter and a layer of aluminum having a thickness ranging from about 8 μm to about 20 μm. Moreover, the inner liner can include a three component laminate of polypropylene-aluminium-polypropylene, the polypropylene having a paper weight ranging from about 20 grams per square meter to about 50 grams per square meter and the aluminum layer having a thickness ranging from about 8 μm to about 20 μm.

Also in the preferred embodiment, the means to open and reclose the opening of the inner liner include a label attached to the inner liner. Preferably, the label extends at least over the section of the inner liner defining the opening. The label has a tacky portion which is releasably attached to the inner liner. Moreover, the label and the tacky portion of the inner liner are connected by a low tack connection. Preferably, the section of the inner liner defining the opening is bounded by at least one line of weakness and the label has a permanent attachment portion. The permanent attachment portion of the label and the section of the inner liner defining the opening can be connected by a high tack connection. Preferably, the section of the inner liner defining the opening is located in a top panel of the inner liner. In an alternative embodiment, the section of the inner liner defining the opening can be located in the top panel and can extend into the front panel of the inner liner. In the preferred embodiment, the label extends essentially over the entire width of the top panel of the inner liner.

BRIEF DESCRIPTION OF THE DRAWINGS

The invention will be further described, by way of example only, with reference to the accompanying drawings.

DETAILED DESCRIPTION

Figure 1:
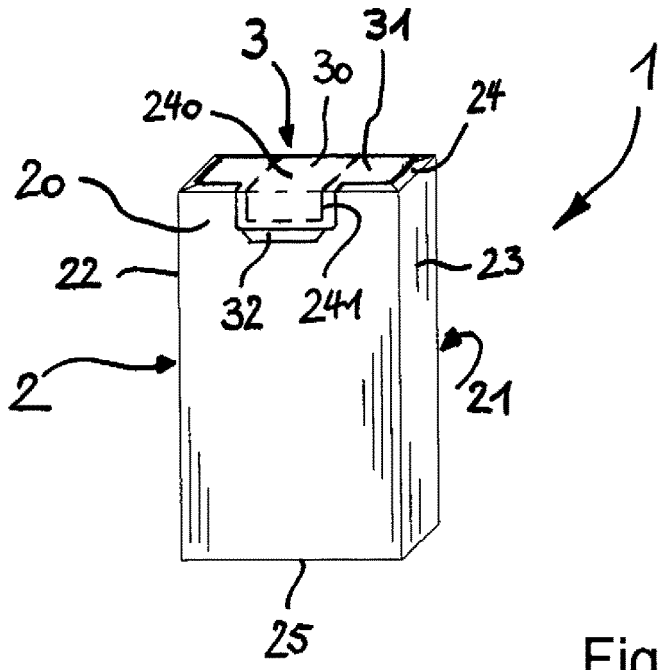
FIG. 1 is a perspective view of an inner liner.

A reclosable container for consumer items includes a box and a lid. The lid is hingedly connected to the box. In a preferred embodiment, the container further includes an inner liner wrapped around the consumer items. The inner liner includes a section defining an opening for allowing access to the consumer items and means to open and reclose the opening. Preferably the container also includes an inner frame attached to the box. The inner frame includes a free inner frame portion protruding from the box towards the opening in the inner liner. The free inner frame portion includes a cut out and the inner frame is attached to the inner liner proximate to the cut out.

Advantageously, attaching the inner frame to the inner liner increases the structural strength of the inner liner near the inner frame. This allows for the reliable reclosing of the container even when a number of the consumer items have been removed from the container as the inner liner is attached to the rigid outer container via the inner frame.

Preferably, the inner liner is glued to the inner frame along the cut out with a number of glue spots or glue lines or combinations thereof. Preferably, the glue is applied to the inner liner during the assembly of the container.

Preferably, the inner liner is made from a material with a bending stiffness ranging from about 4.5 N/m to about 12 N/m.

The bending stiffness is measured according to the Schlenker method as described in DIN 53364.

The relatively high bending stiffness of the inner liner also advantageously provides the container with sufficient structural strength to allow for the reliable reclosing of the container even after a number of the consumer items have been removed from the container. Advantageously, an additional inner frame inside the inner liner is not required. This reduces the production cost of such a container while maintaining the desired reclosability until the last consumer item is removed. In addition, the production of the reclosable container with such an inner liner may be performed on existing packaging machinery with little or no modification. This allows a high speed production process.

More preferably, the inner liner has a bending stiffness ranging from about 4.5 N/m to about 8 N/m. Most preferably, the inner liner has a bending stiffness ranging from about 5 N/m to about 7 N/m.

Preferably, the inner liner has a bending stiffness in machine direction that is higher than the bending stiffness in transverse direction, that is, perpendicular to the machine direction. The machine direction is the direction in which the inner liner is transported through the packaging machine. For example, the inner liner has a bending stiffness in machine direction that is about 1 N/m higher than the bending stiffness in transverse direction, preferably ranging from about 5.5 N/m to about 8 N/m.

Preferably, the inner liner includes a layer of paper having a weight ranging from about 80 grams per square meter to about 150 grams per square meter and a layer of aluminum having a thickness ranging from about 8 μm to about 20 μm.

Alternatively, the inner liner includes a three component laminate of polypropylene-aluminium-polypropylene, the polypropylene layer having a weight ranging from about 20 grams per square meter to about 50 grams per square meter and the aluminum layer having a thickness ranging from about 8 μm to about 20 μm. In the context of the invention, the term "polypropylene" is intended to include also suitable copolymers of polypropylene.

Preferably, the means to open and reclose the opening of the inner liner include a label attached to the inner liner. The label extends at least over the section of the inner liner defining the opening and has a tacky portion which is releasably attached to the inner liner. Detaching the tacky portion of the label from the inner liner allows access to the consumer items through the opening of the inner liner, which can be reclosed by attaching again the tacky portion of the label to the inner liner. Such a label is a convenient means for opening and reclosing the container. In addition, using a label as means to open and reclose the opening of the inner liner is simple and cost effective as the inner liner remains substantially unchanged compared to standard inner liner used in packaging of smoking articles. Application of a label during the manufacture of packaging is a well known process that may be performed at high speed with high precision.

The label may have any shape which is suitable to fully cover that section of the inner liner defining the opening so as to be able to reclose the opening as the label is reattached to the inner liner. For example, the label may at least partially be rectangular, triangular, semi-circular, semi-oval or trapezoid, or may have any other suitable shape.

Preferably, the tacky portion of the label and the inner liner are connected by a low tack connection. The term "low tack connection" is used in this context to describe the tackiness of the connection between the tacky portion of the label and the inner liner. The "low tack connection" allows the label to remain attached to the inner liner when no detachment force is applied to the label. On the other hand, once a consumer applies a detachment force to the label, the tacky portion of the label is detached from the inner liner so as to allow the consumer to access the consumer items through the opening of the inner liner. Thereafter, the label can be reattached to the inner liner to reclose the opening.

The "low tack connection" can be formed, for instance, using a suitable adhesive, for example a synthetic semi-pressure sensitive hotmelt adhesive such as PRIMAGRIP 38-638, or a water based polyethylene adhesive such as TOBACOLL ZD 4404-01, both available from Henkel & Cie AG. Also, a removable acrylic based adhesive can be used. Alternatively, means other than an adhesive, for example a double-sided tacky tape or a Velcro®-fastener, can be used.

Preferably, the section of the inner liner defining the opening is bounded by at least one line of weakness and the label has a permanent attachment portion. The permanent attachment portion of the label and the section of the inner liner defining the opening are connected through a high tack connection. The term "high tack connection" is used in this context to describe the tackiness of the connection between the permanent attachment portion of the label and the portion of the inner liner defining the opening. The "high tack connection" keeps the label attached to the inner liner even when a detachment force is applied to the label. For the purpose of this application, the "high tack connection" between the label and the section defining the opening can be regarded as a permanent connection which is not released during normal use of the container. Upon detaching the releasably attached tacky portion of the label from the inner liner for the first time, the inner liner ruptures along the at least one line of weakness, for example a perforation line. Thus, the section of the inner liner defining the opening gets separated from the rest of the inner liner since this section of the inner liner remains attached to the permanent attachment portion of the label. Thus, the opening is generated in the inner liner which allows the consumer to access the consumer items.

For example, the high tack connection can be formed using a suitable adhesive. Suitable adhesives are known in the art, for example a standard hotmelt adhesive.

The at least one line of weakness is preferably a perforated line but may also be a creasing line or a scoring line. The line of weakness can be created on-line on the packing machine or, alternatively, the inner liner can be provided with the perforated line in an off-line process.

Preferably, the portion of the inner liner defining the opening is located in the top panel of the inner liner. The location of the opening in the top panel of the inner liner is particularly advantageous for cigarette containers, especially hinge lid containers, in which the smoking articles are provided in the inner liner that is arranged within a rigid outer container.

More preferably, the section of the inner liner defining the opening is located in the top panel and extends into the front panel of the container. This embodiment is even more convenient for a consumer when trying to access the cigarettes through the opening in the inner liner. Alternatively, the section of the inner liner defining the opening extends over the back panel, top panel and into the front panel of the container.

Alternatively or in addition, the label extends essentially over the entire width of the top panel of the container. This allows a comparatively large opening to be provided in the inner liner so as to allow convenient access to the consumer items, and at the same time provides for a secure attachment/reattachment of the tacky portion of the label to the inner liner since the attachment surface is sufficiently large, too.

Containers find particular application as containers for elongate smoking articles such as for example cigarettes, cigars or cigarillos. It will be appreciated that through appropriate choices of the dimensions thereof, containers may be designed for different numbers of conventional size, king size, super-king size, slender or very slender cigarettes. Alternatively other consumer items may be housed inside the container.

Through an appropriate choice of the dimensions thereof, containers may also be designed to hold different total numbers of smoking articles, or different arrangements of smoking articles. For example, through an appropriate choice of the dimensions thereof, containers may be designed to hold a total of ten, fifteen, sixteen, seventeen, eighteen, nineteen, twenty, twenty-one or twenty five smoking articles. These may be arranged in different collations, depending on the total number of smoking articles. Preferably, the overall dimensions of the container range from about 1 mm to about 4 mm larger than the collation of smoking articles in length, width or depth or combinations thereof.

The length, width and depth of containers may be such that, in the closed position, the resultant overall dimensions of the container are similar to the dimensions of a typical hinge-lid container for smoking articles.

The exterior surfaces of containers may be printed, embossed, debossed or otherwise embellished with manufacturer or brand logos, trade marks, slogans and other consumer information and indicia.

Once filled, containers may be shrink-wrapped or otherwise overwrapped with a transparent polymeric film of, for example, polyethylene or polypropylene, in a conventional manner. Where containers are overwrapped, the overwrapper may include a tear tape. The tear tape is preferably positioned around the container below the lower edge of the front panel of the lid portion, such that once the tear tape has been removed, the lid portion is free to be pivoted about the hinge line. Alternatively, the tear tape may be provided lengthways around the container. In addition, the over wrapper may be printed with images, consumer information or other data.

In the perspective view of FIG. 1 an embodiment of the reclosable container 1 is shown. The smoking articles contained in the reclosable container are not visible in FIG. 1. The reclosable container 1 includes an inner liner 2 having a front panel 20, an oppositely arranged back panel 21 (not visible), two side panels 22 and 23, a top panel 24 and a bottom panel 25. Attached to the inner liner 2 is a label 3 which allows to open and reclose the reclosable container 1 in order to get access to the smoking articles contained therein.

The label 3 includes a permanent attachment portion 30 which is attached to an inner liner section 240 which is located in the top panel 24 and which extends into the front panel 20. The permanent attachment portion 30 forms a high tack connection with the inner liner section 240 of the inner liner 2. This inner liner section 240 is bounded by a line of weakness 241 (shown in dashed lines in FIG. 1) and defines an opening to be generated in the inner liner 2. The high tack connection between the permanent attachment portion 30 and the inner liner section 240 can be achieved, for example, by means of a suitable hotmelt adhesive which is known.

The label 3 further includes a tacky portion 31 which is releasably attached partly to the top panel 24 and partly to the front panel 20 of the inner liner 2 to form a low tack connection. As already mentioned above, the low tack connection can be achieved through a suitable low tack adhesive, such as PRIMAGRIP 38-638, or a water based polyethylene adhesive such as TOBACOLL ZD 4404-01, both available from Henkel & Cie AG. The label 3 extends essentially over the entire width of the top panel 24 of the inner liner 2, as can be seen in FIG. 1, so that it fully covers the inner liner section 240 defining the opening. The tacky portion 31 is releasably attached to the inner liner 2 in an area located outside the inner liner section 240.

The label 3 further includes a tab 32 which is not attached to the inner liner 2 at all. At the tab 32, the label 3 can be grabbed in order to open and reclose the container 1.

To open the reclosable container 1 for the first time, the consumer grabs the tab 32 of the label 3 and pulls the label 3 towards the top panel 24 of the container 1, thus generating a detachment force on the label 3. This causes the tacky portion 31 of label 3 to be detached from the respective portions of the inner liner 2. Since the inner liner section 240 remains permanently attached to the attachment portion 30 of label 3, the inner liner section 240 is moved together with the label 3 thus causing the inner liner 2 to rupture along the perforated line 241. To reclose the reclosable pack 1 again, the consumer moves the label 3 to its original position and attaches the tacky portion 31 to the inner liner 2 again. This operation can be carried out repeatedly—with the exception of the rupturing of the inner liner section 240.

Figure 2:
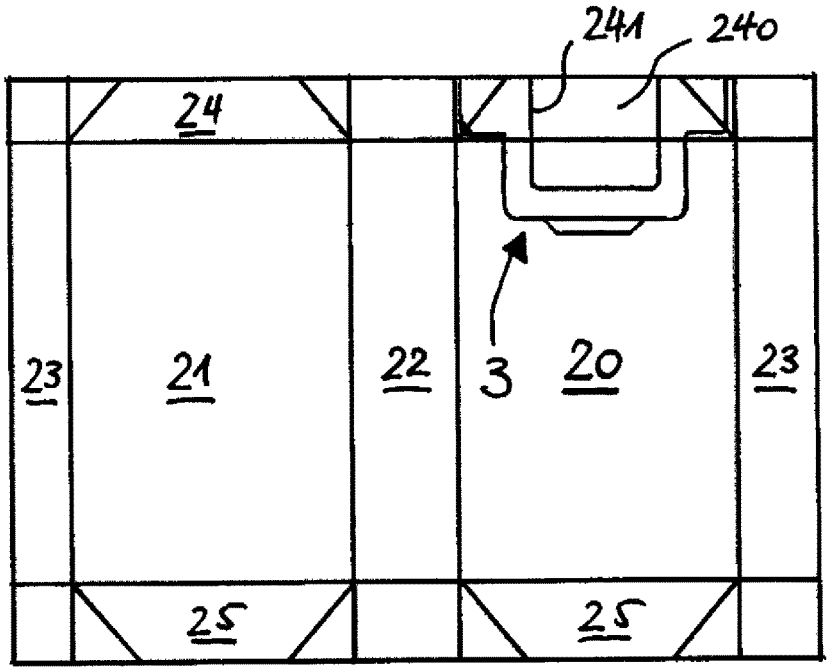
FIG. 2 is an illustration of the inner liner blank of the inner liner of FIG. 1.
Figure 3:
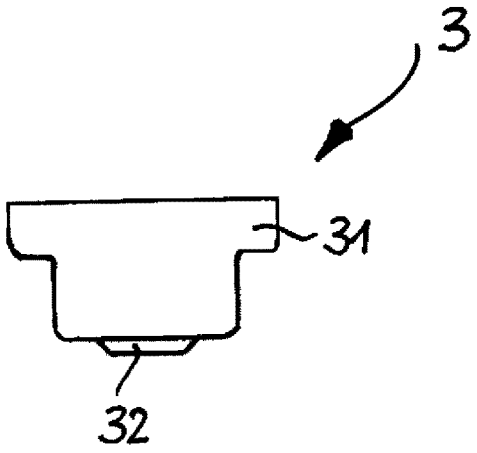
FIG. 3 is an illustration of the separate label which is to be attached to the inner liner blank.

FIG. 2 shows an embodiment of an inner liner blank prior to being wrapped around a collation of smoking articles. The various portions of the inner liner blank which later form front panel 20, back panel 21, side panel 22 and 23, and the top panel 24 and bottom panel 25 of the inner liner 2, as well as the various folding lines are shown in FIG. 2. Also indicated schematically in FIG. 2 is the separate label 3 which is shown in more detail in FIG. 3.

The folding of the inner liner blank 2 along the various folding lines and the attachment, for example by gluing or sealing, of overlapping portions of the folded blank to one another is done in a conventional manner using existing machinery.

Figure 4:
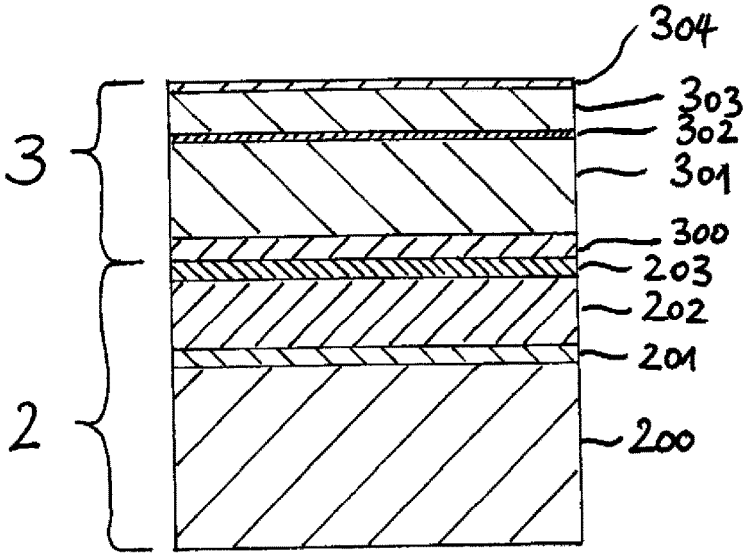
FIG. 4 is a schematic cross section through the various layers of the material of the inner liner and the label.

FIG. 4 shows a cross section through the various layers of the material of one example of an inner liner 2 and a label 3 attached to inner liner 2. Starting with the innermost layer of inner liner 2 (which is the lowermost layer in FIG. 4), the innermost layer 200 is made from a paper having a 90 grams per square meter weight and having a thickness of about 85 μm. The innermost layer 200 is connected by a starch adhesive layer 201 to an aluminum layer 202 having a 27 grams per square meter weight and having a thickness of about 10 μm. A layer 203 of a nitro cellulose based lacquer covers the aluminum layer 202. Label 3 includes an innermost layer 300 of a low tack, non-permanent, adhesive, which is followed by a layer 301 of paper having a 60 grams per square meter weight and having a thickness of about 55 μm. To paper layer 301 an aluminum layer 303 having a thickness of about 9 μm and having a weight of about 25 grams per square meter is laminated with the aid of a layer 302 of a suitable hot melt adhesive for lamination. The aluminum layer 303 is covered by a top layer 304 of PVC solvent based lacquer having a thickness of about 1 μm to about 2 μm.

Figure 5:
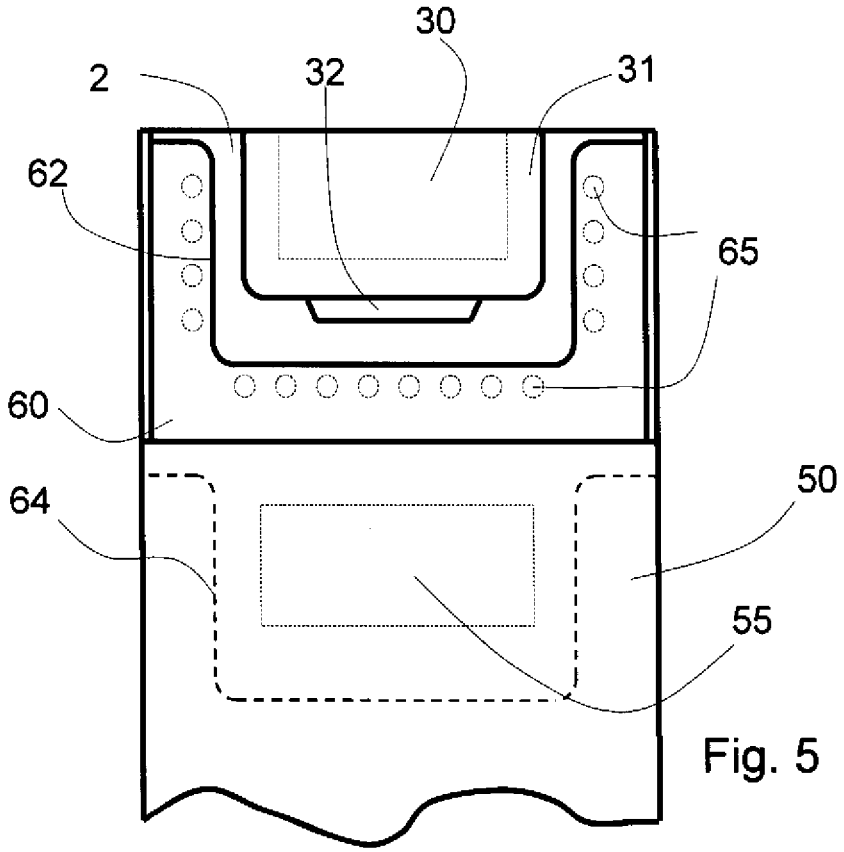
FIG. 5 is a front view of the upper part of a reclosable container with an inner frame.

FIG. 5 shows the upper part of a container. A hinge lid container includes an outer box and an outer lid (not shown) the outer box includes an outer bottom wall (not shown), an outer front wall 50, an outer back wall (not shown) and outer sidewalls (not shown). The container further includes an inner frame 60 arranged between the inner liner 2 and the outer front wall 50. The inner frame 60 is attached to the inside of the outer front wall 50 of the container by a glue area 55 and the outer sidewalls of the container. The inner frame includes a generally U-shaped cut out 62 that substantially follows the outer edge of the label 3. The inner frame 60 is attached to the inner liner 2 by a number of hot melt glue spots 65 proximate to the generally U-shaped cut 62. The attachment of the inner liner 2 to the inner frame 60 near the tacky portion 31 stabilizes the inner liner 2 to allow the reliable reclosure of the inner liner 2.

While the inner liner with the relatively high bending stiffness ranging from about 4.5 N/m to about 8 N/m houses the smoking articles within the outer pack of the container, it is also possible to attain improved reclosability of the container without an outer pack due to the stiffness of the inner liner itself. For example, the consumer items are housed in such an inner liner alone, or alternatively, are packed in such an inner liner as a soft pack.

In this specification, the word "about" is often used in connection with numerical values to indicate that mathematical precision of such values is not intended. Accordingly, it is intended that where "about" is used with a numerical value, a tolerance of ±10% is contemplated for that numerical value.

In this specification the words "generally" and "substantially" are sometimes used with respect to terms. When used with geometric terms, the words "generally" and "substantially" are intended to encompass not only features which meet the strict definitions but also features which fairly approximate the strict definitions.

While the foregoing describes in detail a preferred reclosable container with reference to a specific embodiment thereof, it will be apparent to one skilled in the art that various changes and modifications may be made to the reclosable container, which do not materially depart from the spirit and scope of the foregoing description. Accordingly, all such changes, modifications, and equivalents that fall within the spirit and scope of the appended claims are intended to be encompassed thereby.

I claim:

1. A reclosable container for consumer items, the reclosable container comprising:

an inner liner wrapped around consumer items and excluding an inner frame inside the inner liner, the inner liner including a removable inner liner section defining an opening for allowing internal access and bounded by at least one line of weakness, said inner liner further including a top panel, a front panel, and a back panel arranged opposite of the front panel, wherein the removable inner liner section comprises a first portion of the top panel and a first portion of the front panel;

a label operable to open and reclose the opening, the label including an attachment portion attached to the removable inner liner section with a high tack adhesive and a tacky portion which is releasably attached with a low tack adhesive to a second portion of the top panel surrounding the first portion of the top panel of the removable inner liner section and releasably attached to a second portion of the front panel surrounding the first portion of the front panel of the removable inner liner section, the tacky portion being operable to reseal the inner liner, the attachment portion operable to be moved together with the removable inner liner section when opening the opening; and wherein the inner liner is made from a paper material having an aluminum layer.

2. The reclosable container of claim 1, wherein the inner liner is made from a material with a bending stiffness ranging from about 5 N/m to about 7 N/m.

3. The reclosable container of claim 1, wherein the inner liner comprises a layer of paper having a weight ranging from about 80 grams per square meter to about 150 grams per square meter and the aluminum layer has a thickness ranging from about 8 μm to about 20 μm.

4. The reclosable container of claim 1, wherein the label extends over substantially an entire width of the top panel of the inner liner.

5. The reclosable container of claim 1, wherein the label includes a tab that is not attached to the inner liner.

6. The reclosable container of claim 1, wherein the paper material has a sufficient bending stiffness to support resealing and is free of a separate back-up panel.

7. The reclosable container of claim 1, wherein a paper layer of the label has a lower weight than the paper material of the inner liner.

8. The reclosable container of claim 1, wherein the label superposes only the top panel and the front panel, the inner liner having a rectangular perimeter when in an unfolded condition, the label disposed within the perimeter when the inner liner is in the unfolded condition.

9. The reclosable container of claim 1, wherein the inner liner contains smoking articles prior to rupture of the inner liner along the at least one line of weakness.

10. A reclosable container for consumer items, the reclosable container comprising:

a box; and a lid, the lid being hingedly connected to the box; the reclosable container containing:

an inner liner wrapped around consumer items and excluding an inner frame inside the inner liner, the inner liner including a removable inner liner section defining an opening for allowing internal access and bounded by at least one line of weakness, said inner liner further including a top panel, a front panel, and a back panel arranged opposite of the front panel, wherein the removable inner liner section comprises a first portion of the top panel and a first portion of the front panel; and a label operable to open and reclose the opening, the label including an attachment portion attached to the removable inner liner section with a high tack adhesive and a tacky portion which is releasably attached with a low tack adhesive to a second portion of the top panel surrounding the first portion of the top panel of the removable inner liner section and releasably attached to a second portion of the front panel surrounding the first portion of the front panel of the removable inner liner section, the tacky portion being operable to reseal the inner liner, the attachment portion operable to be moved together with the removable inner liner section upon rupturing the inner liner along the at least one line of weakness when opening the opening.

11. The reclosable container of claim 10, wherein the inner liner is made from a paper material having an aluminum layer.

12. The reclosable container of claim 10, wherein an inner frame is arranged between the inner liner and an outer front wall of the box wherein the inner frame is glued to the inside of the outer front wall, and the inner liner is glued to the inner frame.

13. The reclosable container of claim 11, wherein the paper material has a sufficient bending stiffness to support resealing and is free of a separate back-up panel.

14. The reclosable container of claim 10, wherein the inner liner is made from a material with a bending stiffness ranging from about 5 N/m to about 7 N/m.

15. The reclosable container of claim 10, wherein the inner liner comprises a layer of paper having a weight ranging from about 80 grams per square meter to about 150 grams per square meter and a layer of aluminum having a thickness ranging from about 8 μm to about 20 μm.

16. The reclosable container of claim 10, wherein the inner liner comprises a three component laminate of polypropylene-aluminum-polypropylene, the polypropylene having a paper weight ranging from about 20 grams per square meter to about 50 grams per square meter and the aluminum layer having a thickness ranging from about 8 μm to about 20 μm.

17. The reclosable container of claim 10, wherein the label includes a tab that is not attached to the inner liner.

18. The reclosable container of claim 10, wherein a paper layer of the label has a lower weight than a layer of paper of the inner liner.

19. The reclosable container of claim 10, wherein the label superposes only the top panel and the front panel, the inner liner having a rectangular perimeter when in an unfolded condition, the label disposed within the perimeter when the inner liner is in the unfolded condition.

20. The reclosable container of claim 10, wherein the label extends over substantially an entire width of the top panel of the inner liner.

* * * * *